US005706734A

United States Patent [19]

Theuerer

[11] Patent Number: 5,706,734

[45] Date of Patent: Jan. 13, 1998

[54] BALLAST TAMPING MACHINE, AND METHOD OF TAMPING BALLAST UNDER A TRACK

[75] Inventor: Josef Theuerer, Vienna, Austria

[73] Assignee: Franz Plasser Bahnbaumaschinen Industriegesellschaft m.b.H., Vienna, Austria

[21] Appl. No.: 747,461

[22] Filed: Nov. 12, 1996

[30] Foreign Application Priority Data

Nov. 22, 1995 [AT] Austria ..... 1903/95

[51] Int. Cl.[6] ..... E01B 27/02

[52] U.S. Cl. ..... 104/12

[58] Field of Search ..... 104/12

[56] References Cited

U.S. PATENT DOCUMENTS

| | | | |
|---|---|---|---|
| 4,094,250 | 6/1978 | Theurer | 104/12 |
| 4,773,333 | 9/1988 | Theurer | 104/12 |
| 5,048,425 | 9/1991 | Theurer | 104/12 |
| 5,133,263 | 7/1992 | Theurer | 104/12 |

*Primary Examiner*—S. Joseph Morano
*Attorney, Agent, or Firm*—Henry M. Feiereisen

[57] ABSTRACT

A tamping assembly for use in a tamping machine for compacting ballast under a group of neighboring ties of a track, includes tool carriers in spaced-apart relationship in direction of the track and vertically adjustable independently from one another, with one tool carrier including three tamping tools spaced from each other in direction of the track, and with a second tool carrier including two tamping tools spaced from each other in direction of the track wherein each of the tamping tools of the first and second tool carriers is formed with a tamping pick for immersion into the ballast. At least one of the tamping tools of the second tool carrier which neighbors the first tool carrier is adapted for movement along a first tamping direction for enabling the tamping tools of the second tool carrier to travel toward each other in direction of the axis and to tamp ballast under one tie, and along a second tamping direction for enabling the tamping tools of the second tool carrier to travel away from each other and tamp ballast under another tie in conjunction with a tamping tool of the neighboring tool carrier.

13 Claims, 3 Drawing Sheets

BALLAST TAMPING MACHINE, AND METHOD OF TAMPING BALLAST UNDER A TRACK

BACKGROUND OF THE INVENTION

The present invention refers to a ballast tamping machine and method of tamping ballast under a track, and in particular to a ballast tamping assembly for use in a ballast tamping machine.

German Pat. No. DE-A1-2 426 841 describes a tamping assembly for compacting ballast under a group of three immediately following ties of a track. The track assembly includes two tool carriers which are spaced apart in longitudinal direction of the track and vertically adjustable independently from one another along vertical guide columns, with the tool carriers being positioned above the outer ones of the group of three ties. Each tool carrier is provided with three tamping tools which are connected to an eccentric shaft that generates a swinging motion of the tamping tools. Two of the three tamping tools of each tool carrier form a pair which is moveable longitudinally in direction of the track along a tamping direction for compacting the respectively outer tie. The third tamping tools of the two tool carriers are so disposed as to form together a further pair that is associated to the center tie and is also moveable towards each other longitudinally in direction of the track in tamping direction for compacting ballast under the center tie. The actuation of the tamping tools of the tool carriers in the tamping direction is effected by hydraulic screw drive mechanisms.

U.S. Pat. No. 3,343,497 discloses a ballast tamping assembly for simultaneous compacting of three neighboring ties. The tamping assembly includes two tool carriers secured to a machine frame and spaced from each other by the distance between two ties. Each tool carrier includes a pair of tamping tools which are connected by a drive mechanism in the form of piston-cylinder arrangements. At operation, one pair of tamping tools is lowered into the ballast on either side of the first tie, and the other pair of tamping tools is simultaneously lowered into the ballast on either side of the third tie of the group of three ties for compacting ballast under the ties. Each tamping tool is further equipped with a separate vibrator. Tamping of the center tie is effected through operation of the drive mechanism of the tool carriers in opposite direction so that the adjacent inner tamping tools of the tool carriers are moved towards each other for consolidating the ballast beneath the center tie. During the tamping operation of the center tie, the outer tamping tools that are furthest apart from each other in longitudinal direction of the track move up against a stop and remain in this position until the tamping of ballast under the center tie has been completed.

German Pat. No. DE-A-1-2 005 187 discloses a tamping machine with a plurality of separate tamping units secured to a machine frame and positioned in succession in longitudinal direction of the track. Each tamping unit is assigned to a single tie and can be lowered into the ballast bed independently from the other tamping units. Such a ballast tamping machine is of very complicated structure.

German Pat. No. DE-A1-2 460 700 discloses a tamping machine with three pairs of tamping tools for compacting a group of three ties, with the tamping tools being secured to a single tool carrier. Such a tamping machine has the drawback that it does not allow for a selective lowering of only one part of the tamping tools when encountering e.g. a track obstacle.

SUMMARY OF THE INVENTION

It is an object of the present invention to provide an improved ballast tamping machine, obviating the aforestated drawbacks.

In particular, it is an object of the present invention to provide an improved tamping assembly which enables a compacting of ballast under the track in a simple, economical and yet reliable manner.

It is yet another object of the present invention to provide an improved method of tamping ballast under ties of a track.

These objects and others which will become apparent hereinafter are attained in accordance with the present invention by providing a first tool carrier with three tamping tools which are spaced form one another successively in direction of the track, and a second tool carrier with two tamping tools spaced from one another successively in longitudinal direction of the track, wherein at least the one of the two tamping tools of the second tool carrier which neighbors the first tool carrier has a double-acting drive mechanism for movement of the one tamping tool along a first tamping direction in which the tamping tools of the second tool carrier travel towards each other to compact ballast under one tie, and along a second tamping direction in which the tool tamping tools of the second tool carrier travel away from one another to enable the one tamping tool of the second tool carrier to compact ballast under another tie in conjunction with a tamping tool of the neighboring first tool carrier.

The provision of a tamping assembly with two carriers that respectively support a different number of tamping tools in combination with the application of a special double acting drive mechanism that enables two operative tamping motions, afford the operator the possibility to best suit the tamping machine to varying tamping conditions in the form of e.g. different tie spacing, tamping obstacles, switches and turnouts. These conditions would impede and even prevent a simultaneous lowering of a number of tamping tools arranged successively longitudinally in the direction of the track. As a result of the asymmetric disposition of the tamping tools relative to the tool carriers, the necessity for a close disposition of the tamping tools which for space reasons is very difficult to attain is eliminated, and a stepwise addition of individual tool carriers in dependence on the track conditions is possible. Thus, the tamping machine can be operated at especially high tamping capability and ensures a continuous tamping even at difficult track conditions e.g. in switch sections.

According to another feature of the present invention, the tamping assembly may include a third tool carrier which is spaced from the first and second tool carriers in longitudinal direction of the track and vertically adjustable independently therefrom, with the second tool carrier being positioned between the first and third tool carriers. The third tool carrier resembles the first tool carrier and thus includes three tamping tools. In a configuration of the tamping assembly with three tool carriers, each tamping tool of the second tool carrier is actuated by a double acting drive for moving the tamping tool in two tamping directions, with an operation along a first tamping direction allowing compaction of ballast under one tie through movement of the tamping tools of the second tool carrier towards one another, and with an operation along a second tamping direction allowing compaction of ballast under the neighboring ties in conjunction with the adjacent tamping tool of the first and third tool carriers through movement of the tamping tools of the second tool carrier apart from one another.

Preferably, the tamping tools of the three tool carriers are disposed symmetrically with respect to a plane of symmetry extending perpendicular to the longitudinal direction of the machine frame.

Each tamping tool is formed with a tamping pick for immersion into the ballast, wherein the tamping picks of the tamping tools of the second tool carrier are formed with flattened plate-like ends to exhibit two work areas facing away from each other.

According to another feature of the present invention, the tamping assembly includes an auxiliary lifting unit positioned in an area of the second tool carrier and including a lifting member for form-fitting grasping and lifting of the track.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
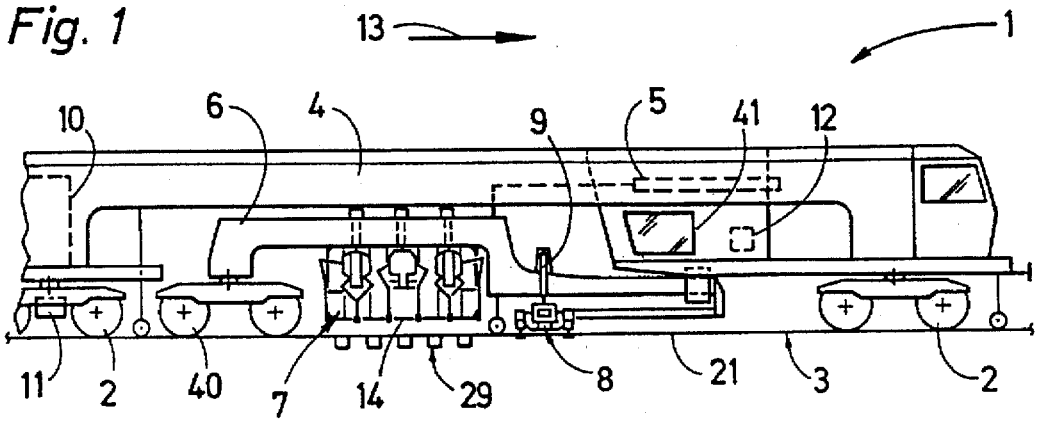
FIG. 1 is a simplified side elevational view of one embodiment of a tamping machine according to the present invention, showing a tamping assembly for compacting a group of five neighboring ties.

Throughout all the Figures, the same or corresponding elements are generally indicated by the same reference numerals.

Turning now to the drawing, and in particular to FIG. 1, there is shown a simplified side elevational view of one embodiment of a tamping machine according to the present invention, generally designated by reference numeral 1. The tamping machine 1 includes a machine frame 4 which is supported by undercarriages 2 for traveling along a track 3 in an operating direction as indicated by arrow 13. The machine frame 4 is propelled along the track 3 by a drive 11 which acts upon the trailing undercarriage 2. The tamping machine 1 further includes a slave frame 6 which extends in a cavity of the machine frame 4 and is movable relative thereto by a drive 5. The slave frame 6 rolls on an undercarriage 40 along the track 3 and supports an auxiliary frame 14 which carries a tamping assembly 7 and a track lifting and lining unit 8 which is operated by a lifting drive 9. A power plant 10 is mounted to the machine frame 4 to supply power to the drive 11 and to all drives of the machine 1 which are actuated by a control unit 12 from an operator's cab 41.

Figure 2:
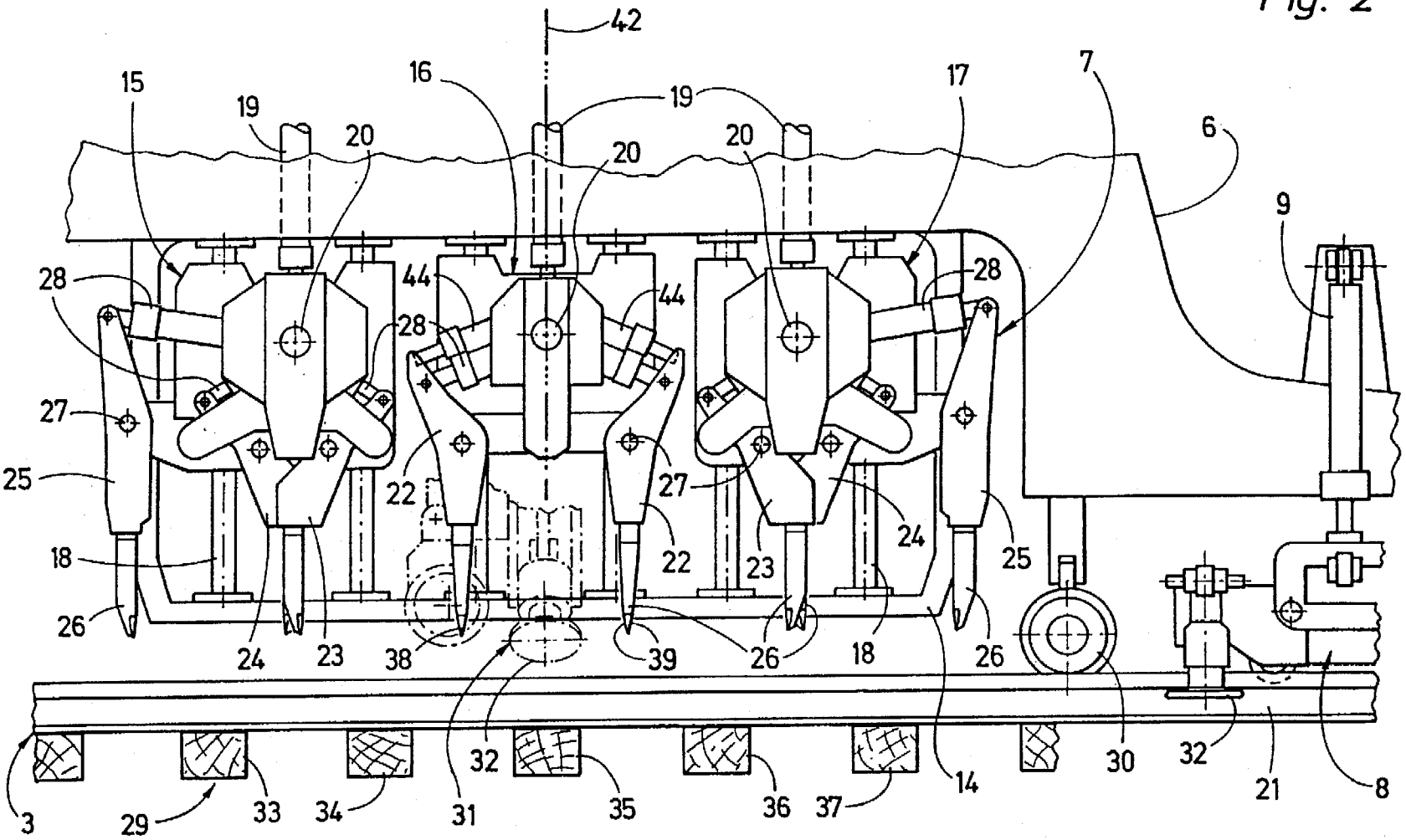
FIG. 2 is a fragmentary side elevational view of the tamping assembly of FIG. 1, on an enlarged scale.

As shown in FIG. 2, the tamping assembly 7 includes three tool carriers 15, 16, 17 which are spaced successively in direction of the track 3. Each tool carrier 15, 16, 17 is equipped with a separate eccentric shaft 20 and supported on two vertical guide columns 18 of the auxiliary frame 14 for separate adjustment in vertical direction by a separate drive 19 so that the tool carriers 15, 16, 17 are independently vertically adjustable from one another. The first or leading tool carrier 15 and the third or trailing tool carrier 17 are each provided with three tamping tools 23, 24, 25 which are in spaced-apart relationship in longitudinal direction of the track 1 for immersion into the ballast on one longitudinal side of a rail 21 of the track 3. The second or center tool carrier 16 which is positioned between the outer first and third tool carriers 15, 17 as viewed longitudinally in direction of the track 3 includes two tamping tools 22 which are spaced from one another longitudinally in direction of the machine 1. The tamping tools 22, 23, 24, 25 are swingable about a horizontal axis 27 extending transversely to the machine frame and are connected to the eccentric shaft 20 of the respective tool carrier 15, 16, 17 by a drive 28. At their lower extremities each of the tamping tools 22, 23, 24, 25 is formed with a tamping pick 26, whereby the tamping picks 26 of the tamping tools 23, 24 of the tool carriers 15, 17 slightly overlap each other in transverse direction of the machine 1. The tamping tools 22, 23, 24, 25 are arranged symmetrically with respect to a plane of symmetry 42 which extends perpendicular to the longitudinal direction of the machine 1.

Although not shown in the drawings in detail, persons skilled in the art will understand that each tool carrier 15, 16, 17 certainly includes a same number of tamping tools also on the other longitudinal side of the rail to thereby effect a tamping of ballast under the ties on the gage side as well as on the field side, i.e. each two carrier 15, 16, 17 has two tamping tools respectively opposing each other transversely to the direction of the machine frame. Thus, the tool carriers 15, 17 exhibit a total of six tamping tools and the tool carrier 16 exhibits a total of four tamping tools for compaction of ballast under the ties when lowering the tool carriers 15, 16, 17 to provide a suitable support for the ties.

As indicated in FIG. 2 by dash-dot lines, the tamping machine 1 has an auxiliary lifting unit 31 which is situated in the area of the second tool carrier 16. The auxiliary lifting unit 31 is provided in similar fashion as the track lifting and lining unit 8 with a lifting member 32 in the form of a clamp-like flanged roller for form-fitting grasping and lifting of the rail 21 of the track 3, whereby the lifting unit 31 is connected to the slave frame 6 and the auxiliary frame 14 in a vertically adjustable manner. A feeler 30 pertaining to the machine-own reference system is mounted to the slave frame 6 between the tamping assembly 7 and the track lifting and lining unit 8 for registering the track geometry.

For simultaneous compacting of a group 29 of five neighboring ties 33, 34, 35, 36, 37 of the track 3, the tamping tools 22, 23, 24, 25 are movable towards each other in pairs in longitudinal direction of the track by means of their drives 28, whereby the tamping tools 25 of the outermost tool carriers 15, 17 and their neighboring tamping tools 24 form respective pairs associated to the outer ties 33, 37 of the group 29. The tamping tools 22 of the second tool carrier 16 also form during operation in one tamping direction a pair for compacting the center tie 35 in an initial phase. However, as the drive 28 for each of the tamping tools 22 is of double acting configuration, the tamping tools 22 are moveable in addition to their movement towards each other also along a second tamping direction in which the tamping tools are moved apart in direction away from each other to form with the immediately adjacent tamping tools 23 of the first and third tool carriers 15, 17 pairs for compacting the ties 34, 36 which are respectively positioned next to the central tie 35 of the group 29 at each side thereof. As the tamping tools 22 of the second tool carrier 16 are moveable along two tamping directions to effect a tamping of respective ties, the lower extremities of the tamping picks 26 of the tamping tools 22 are formed with flattened plate-like ends 38 to exhibit two work surfaces facing away from each other in longitudinal direction of the machine frame for immersion into the cribs between the ties.

In order to precisely limit the motion of the tamping tools 22 along the two tamping directions, both drives 28 of the second tool carrier 16 incorporate therein a locking mechanism 44 in form of a cylinder-piston arrangement. FIG. 2 shows the locking mechanism 44 of each drive 28 in activated position in which the swinging motion of the tamping tool 22 about the axis 27 is blocked when occupying the vertical center position, i.e. both tamping tools 22 can be pivoted only in a direction towards one another to effect a tamping of ballast under the center tie 35. When the piston of each locking mechanism 44 occupies the retracted position, the tamping tools 22 can be pivoted by their drives 28 beyond the vertical center position in direction towards the respectively adjacent tamping tools 23 of the tool carriers 15, 17 to form pairs of tamping tools, 22, 23 that tamp ballast under the ties 34, 36.

Persons skilled in the art will understand that the description of the locking mechanism 44 in from of a cylinder-piston arrangement is done by way of example only and should not be limited thereto. It is certainly conceivable to configure the locking mechanism in a different manner, e.g. as solenoid-actuated bolt.

Figure 3:
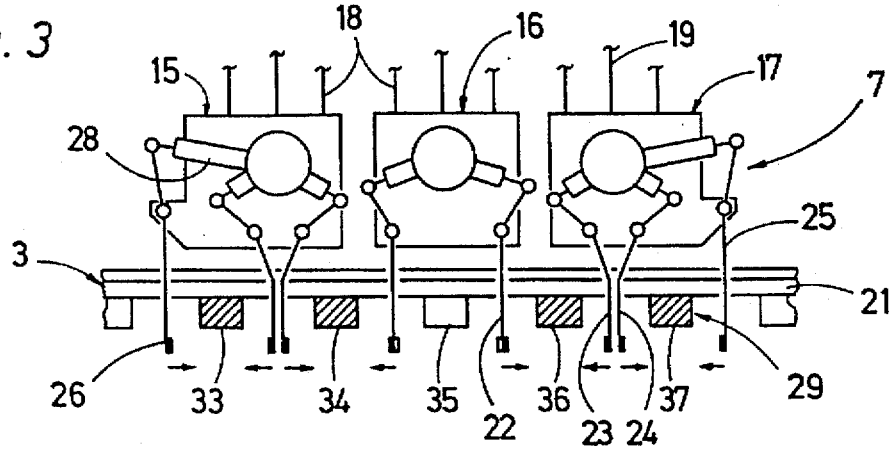
FIG. 3 is a schematic side view of the tamping assembly of FIG. 1, showing a first phase of the tamping operation.

FIG. 3 illustrates the first phase of the two-phase operation of the tamping assembly 7 for simultaneously compacting ballast under the group 29 of ties 33, 34, 35, 36, 37, In the initial phase, the three tool carriers 15, 16, 17 are lowered by the drives 19 to immerse all tamping picks 26 into the ballast. The tamping tools 24, 25 of both first and third tool carriers 15, 17 are moved towards one another to approach the ties 33 and 37, respectively, to thereby effect a compacting of ballast under the ties 33, 37. At the same, the third tamping tool 23 of the tool carriers 15, 17 and the neighboring tamping tools 22 of the second tool carrier 16 are moved towards each other to effect a compacting of ballast under the ties 34 and 36. The movement of the tamping tools 22, 23, 24, 25 is indicated in FIG. 3 by the arrows, with the ties 33, 34, 35, 36, 37 being worked on shown by hatching. Subsequently, after compaction of ballast under the ties 33,34, 36, 37 has been concluded, the three tool carriers 15, 16, 17 are lifted upwardly.

Figure 4:
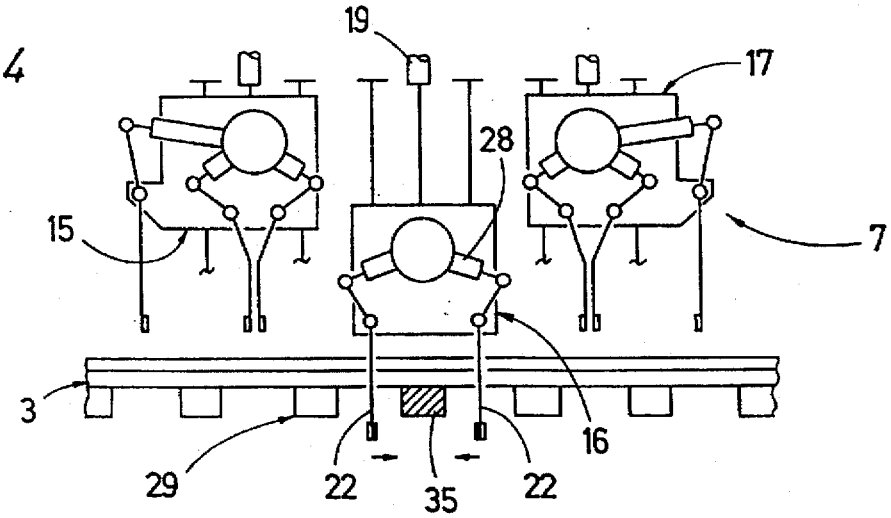
FIG. 4 is a schematic side view of the tamping assembly of FIG. 1, showing a second phase of the tamping operation.

FIG. 4 illustrates the immediately following second phase of the tamping operation in which only the center, second tool carrier 16 is lowered. The tamping tools 22 are now moved towards each other in opposition to the displacement during the first phase, as indicated by the arrows, in order to tamp ballast under the central tie 35 of the group 29. The first and third tool carriers 15, 17 remain in the elevated idle position. After conclusion of the tamping operation with respect of the tie 35 and elevation of the second tool carrier 16 to occupy the idle position, the tamping assembly 7 is advanced together with the slave frame 6 in direction of arrow 13 to the next group of five ties for tamping ballast underneath those ties.

Figure 5:
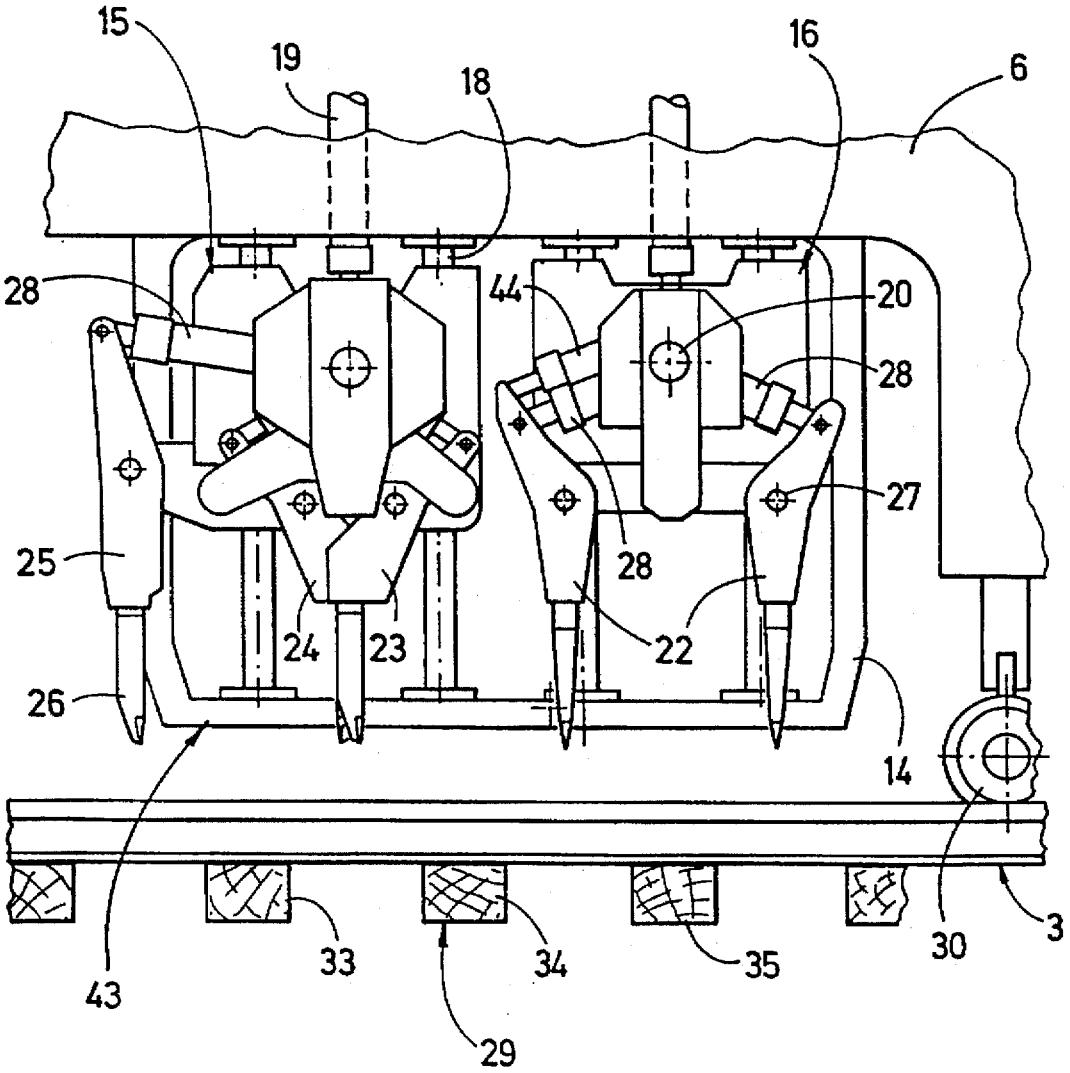
FIG. 5 is a fragmentary, simplified side elevational view of another embodiment of a tamping machine according to the present invention.

Turning now to FIG. 5, there is shown a fragmentary, simplified side elevational view of another embodiment of a tamping machine according to the present invention, including a tamping assembly 43 which essentially corresponds to the tamping assembly 7 according to FIGS. 1 to 4, with the difference residing in the number of tool carriers. The tamping assembly 43 includes only two tool carriers 15, 16, with the first tool carrier 15 including three tamping tools 23, 24, 25 spaced successively in longitudinal direction of the machine, and with a second tool carrier 16 including two tamping tools 22. The drive 28 for the inner tamping tool 22 that neighbors the first tool carrier 15 is configured for double-action movement of this tamping tool 22 for movement along two tamping directions, while the drive 28 for the outer tamping tool 22 is of same single-action mechanism as the drives 28 for the tamping tools 23, 24, 25 of the first tool carrier 15 and thus acts only in one tamping direction.

At tamping operation of a group 29 of three ties 33, 34, 35, both tool carriers 15, 16 are lowered in an initial phase into the respective cribs to compact ballast under the neighboring ties 33 and 34, whereby tamping of the tie 33 is effected by the pair of tamping tools 24, 25 of the tool carrier 15 and tamping of the tie 34 is effected by pairing the tamping tool 23 of the tool carrier 15 with the neighboring inner tamping tool 22 of the tool carrier 16. Subsequently, after elevating both tool carriers 15, 16 to occupy their idle position, only the second tool carrier 16 is lowered again in a second phase to effect a tamping of ballast under the third tie 35 by moving the tamping tools 22 of the tool carrier 16 towards each other.

It will be appreciated by persons skilled in the art that it is certainly possible to configure the drives 28 for double-action movement of both tamping tools 22 of the second tool carrier 16 so that the outer one of the tamping tools 22 can additionally be used for tamping ballast under a fourth tie that neighbors the tie 35.

Persons skilled in the art will understand that the tamping assembly 7 or 43 may also be arranged on a tamping machine which advances from tamping site to tamping site in a stepwise manner and is directly secured to the machine frame. Also, the tamping picks 26 may be swingably secured upon a respective tamping tools 22, 23, 24, 25 in a manner known per se for movement by a drive sideways about an axis which extends longitudinally in direction of the machine frame.

While the invention has been illustrated and described as embodied in a ballast tamping machine, and method of tamping ballast under a track, it is not intended to be limited to the details shown since various modifications and structural changes may be made without departing in any way from the spirit of the present invention.

What is claimed as new and desired to be protected by Letters Patent is set forth in the appended claims:

I claim:

1. A tamping assembly for use in a track tamping machine for tamping ballast under a group of neighboring ties of a track; said tamping assembly comprising:

frame defining an axis;

first and second tool carriers secured to the frame in spaced-apart relationship in direction of the axis and vertically adjustable independently from one another, with the first tool carrier including three tamping tools spaced from each other in direction of the axis, and with the second tool carrier including two tamping tools spaced from each other in direction of the axis, wherein each of the tamping tools of the first and second tool carriers includes a tamping pick for immersion into the ballast; and drive means for moving the tamping tools of the first and second tool carriers in axial direction toward at least three ties to effect a compaction of ballast under the ties, said drive means including:

a first drive mechanism moving two individual ones of the three tamping tools of the first tool carrier towards a first one of the ties, and moving the third one of the three tamping tools towards a second one of the ties, and a second drive mechanism for moving the two tamping tools of the second tool carrier in such a manner that at least one of the two tamping tools moves in a first tamping direction for compacting ballast under the second one of the ties and in a second tamping direction for compacting ballast under a third tie.

2. The tamping assembly of claim 1, and further comprising a third tool carrier spaced from the first and second tool carriers in longitudinal direction of the track and vertically adjustable independently therefrom, said third tool carrier including three tamping tools spaced from each other in direction of the axis and each formed with a tamping pick for immersion into the ballast, wherein the second tool carrier is positioned between the first and third tool carriers in direction of the axis.

3. The tamping assembly of claim 2 wherein the tamping tools of the tool carriers are disposed symmetrically with respect to a plane of symmetry extending perpendicular to the axis.

4. The tamping assembly of claim 2 wherein both tamping tools of the second tool carrier are operated by the second drive mechanism for movement along two tamping directions, thereby enabling the other one of the two tamping tools to move in a tamping direction for allowing compaction of ballast under a fourth tie.

5. The tamping assembly of claim 1 wherein the tamping picks of the tamping tools of the second tool carrier are formed with tamping plates exhibiting two work areas facing away from each other.

6. The tamping assembly of claim 1, and further comprising an auxiliary lifting unit secured to the frame in an area of the second tool carrier and including a lifting member for grasping and lifting of the track in a form-fitting manner.

7. The tamping assembly of claim 1 wherein two of the three tamping tools of the first tool carrier neighbor each other for immersion in a same crib.

8. The tamping assembly of claim 7 wherein the two of the three tamping tools are movable in opposite tamping directions.

9. The tamping assembly of claim 1 wherein the two individual ones of the three tamping tools oppose each other to form a first pair for compaction of ballast under the first tie.

10. A mobile ballast tamping machine movable in an operating direction along a track comprised of two rails fastened to a succession of ties, said tamping assembly comprising:

a frame defining an axis; and a tool carrier assembly secured to the frame for tamping ballast under the ties, said tool carrier assembly including a vertically adjustable first tool carrier including three tamping tools positioned on a side of the rail;

a second tool carrier vertically adjustable independently from the first tool carrier and positioned in spaced-apart relationship thereto in direction of the axis, said second tool carrier including two tamping tools positioned on the side of the rail;

first drive means acting upon the tamping tools of the first tool carrier for moving two tamping tools towards each other for tamping ballast under a first tie and for moving the third tamping tool in direction towards the second tool carrier for tamping ballast under a second tie; and second drive means acting upon the tamping tools of the second tool carrier for moving the tamping tools towards each other for tamping ballast under a third tie, and for moving at least one of the two tamping tools of the second tool carrier in a direction towards the third tamping tool for tamping ballast under the second tie.

11. The tamping machine of claim 10 wherein the tamping tools of the second tool carrier have each a tamping pick formed with tamping plates exhibiting two work areas facing away from one another.

12. The tamping machine of claim 10 wherein the third tamping tool and one of the two tamping tools of the first tool carrier slightly overlap each other in transverse direction of the axis for immersion in a same crib.

13. A method for tamping ballast under a succession of ties of a track, comprising the steps of:

lowering at least two neighboring tool carriers for immersion of tamping tools into a ballast bed;

moving two of three tamping tools of one tool carrier towards each other for tamping ballast under a first tie, and moving the third tamping tool of the one tool carrier and one of two tamping tools of the other tool carrier toward each other for tamping ballast under a second neighboring tie;

elevating the tool carriers to remove the tamping tools from the ballast bed;

lowering the other tool carrier for immersion of the two tamping tools into the ballast bed; and moving the two tamping tools of the other tool carrier towards each other for tamping ballast under a third tie.

* * * * *

UNITED STATES PATENT AND TRADEMARK OFFICE

CERTIFICATE OF CORRECTION

PATENT NO. : 5,706,734

DATED : Jan. 13, 1998

INVENTOR(S) : Joseph Theurer

It is certified that error appears in the above-identified patent and that said Letters Patent is hereby corrected as shown below:

On the title page item,

[75] Inventor: change "THEUERER" to --THEURER--

Signed and Sealed this

Eighth Day of December, 1998

Bruce Lehman

*Attest:*

BRUCE LEHMAN

*Attesting Officer*

*Commissioner of Patents and Trademarks*